US006050403A

United States Patent [19]

Draney

[11] Patent Number: 6,050,403

[45] Date of Patent: Apr. 18, 2000

[54] NECKTIE STORAGE CASE

[75] Inventor: Kent L. Draney, Yakima, Wash.

[73] Assignee: Scott Ross, Spokane, Wash.

[21] Appl. No.: 09/149,228

[22] Filed: Sep. 8, 1998

[51] Int. Cl.[7] ..... B65D 85/18

[52] U.S. Cl. ..... 206/282; 206/293; 206/297; 206/299

[58] Field of Search ..... 206/278, 282, 206/283, 292, 293, 298, 297, 299

[56] References Cited

U.S. PATENT DOCUMENTS

| | | | |
|---|---|---|---|
| D. 299,789 | 2/1989 | Merz . | |
| D. 308,821 | 6/1990 | Dreuer . | |
| 1,912,311 | 5/1933 | Saulnier | 206/282 |
| 2,104,999 | 1/1938 | Markowitz | 206/292 |
| 2,711,276 | 6/1955 | Keefe | 206/282 |
| 3,970,242 | 7/1976 | Swafford et al. . | |
| 4,593,812 | 6/1986 | Dillingham . | |
| 5,181,670 | 1/1993 | Eaton et al. . | |

*Primary Examiner*—Paul T. Sewell
*Assistant Examiner*—Nhan T. Lam
*Attorney, Agent, or Firm*—David S. Thompson

[57] ABSTRACT

A necktie storage case provides an envelope defining a channel sized to carry a folded necktie. A slide allows convenient manual loading and unloading of a folded necktie into the interior channel of the envelope. The slide provides an elongated body sized for travel within the interior channel of the envelope and through a slide slot defined in the envelope. The elongated body of the slide carries a necktie support panel having a size which prevents passage through the slide slot. The slide is movable between three positions, a transfer position, wherein the necktie may be manually attached or removed from the slide; a retracted position, wherein the necktie is fully retracted within the interior channel of the envelope and the elongated body of the slide is withdrawn from the interior channel; and a storage position, wherein the elongated body of the slide is folded against and attached to an outside portion of the envelope.

2 Claims, 5 Drawing Sheets

NECKTIE STORAGE CASE

CROSS-REFERENCES

There are no applications related to this application filed in this or any foreign country.

BACKGROUND

A variety of necktie storage and travel cases are known. Due to the length of neckties, most necktie storage or travel cases unfold, unzip or otherwise open to accept a necktie. The necktie is typically folded in half or quarters and the case is then folded, rolled or otherwise reduced in size.

A problem common to most if not all necktie storage or travel cases is the cost of manufacture. The cost is typically quite high due to the materials used, and also due to the number of straps, fasteners, hooks and other components required in their construction. As a result of their cost, such storage and travel cases are not adapted for use as retail packaging.

A related problem is that most necktie storage and travel cases are bulky, elaborate and difficult to pack or store. Some tend to occupy substantial space even when empty, while others require enough added time to open, close, fasten and unfasten as to make their use less than requent.

For the foregoing reasons, there is a need for a necktie storage and travel case that has a low manufacturing cost, to promote and enhance sales, and to allow use of the case as retail pacaging. The necktie case must be simple and easy to use, to promote widespread and frequent utilization. The necktie case must be compact, adding little volume to stored ties, and must fold flat when not in use. The necktie case must additionally provide a novel structure for loading and unloading neckties, which is operative without the use of elaborate and bulky fasteners.

SUMMARY

The present invention is directed to an apparatus that satisfies the above needs. A novel necktie storage case is disclosed that is low-cost, simple to use, and which provides the means to load and unload neckties without the need for elaborate and bulky fasteners.

The necktie storage case of the present invention provides some or all of the following:

(A) An envelope, sized for storage of a folded necktie within an interior channel, provides in a preferred version:

(a) A left panel, having an elongated planar body typically having a lower edge of slightly greater length than the upper edge. A hanger opening is typically defined in an upper portion of the elongated body, thereby allowing a J-hook or similar retail display support to be used.

(b) A center panel is attached to the left panel along a left fold, and provides a similarly sized elongated body. A hanger opening, slide slot and a window opening are typically defined on an upper portion of the elongated body, and a lower notch is defined along a lower edge of the elongated body.

(c) A right panel is attached to the center panel along a right fold, and provides an elongated body, typically having a surface area less than the left or center panels. A hanger opening is typically defined in an upper portion of the elongated body.

(B) A slide is sized for travel within the interior channel of the envelope, and allows manual loading and unloading of a folded necktie into the interior channel of the envelope. A preferred slide provides an elongated body and a necktie support panel. The elongated body is sized for passage through the slide slot defined in the center panel; however, the necktie support panel is sized to prevent passage through the slide slot. A window opening is defined on the elongated body, and is located to coincide with the window opening in the center panel when the slide is in a storage position.

The slide is movable between a transfer position, wherein the necktie may be manually attached to, or removed from, the slide; a retracted position, wherein the necktie is fully retracted within the interior channel of the envelope and the elongated body of the slide is withdrawn from the interior channel; and a storage position, wherein the elongated body of the slide is folded against and attached to an outside portion of the center panel of the envelope.

It is therefore a primary advantage of the present invention to provide a novel nektie storage and travel case having a low manufacturing cost, allowing for enhanced sales and use it retail packaging.

Another advantage of the present invention is to provide a novel necktie storage and travel case that is simple and easy to use, thereby promoting widespread and frequent utilization.

A still further advantage of the present invention is to provide a novel necktie storage and travel case that is compact in use and which folds flat when not in use, and which is operational without bulky, elaborate and costly fasteners.

DRAWINGS

These and other features, aspects, and advantages of the present invention will become better understood with regard to the following description, appended claims, and accompanying drawings where:

Figures 4, 9:
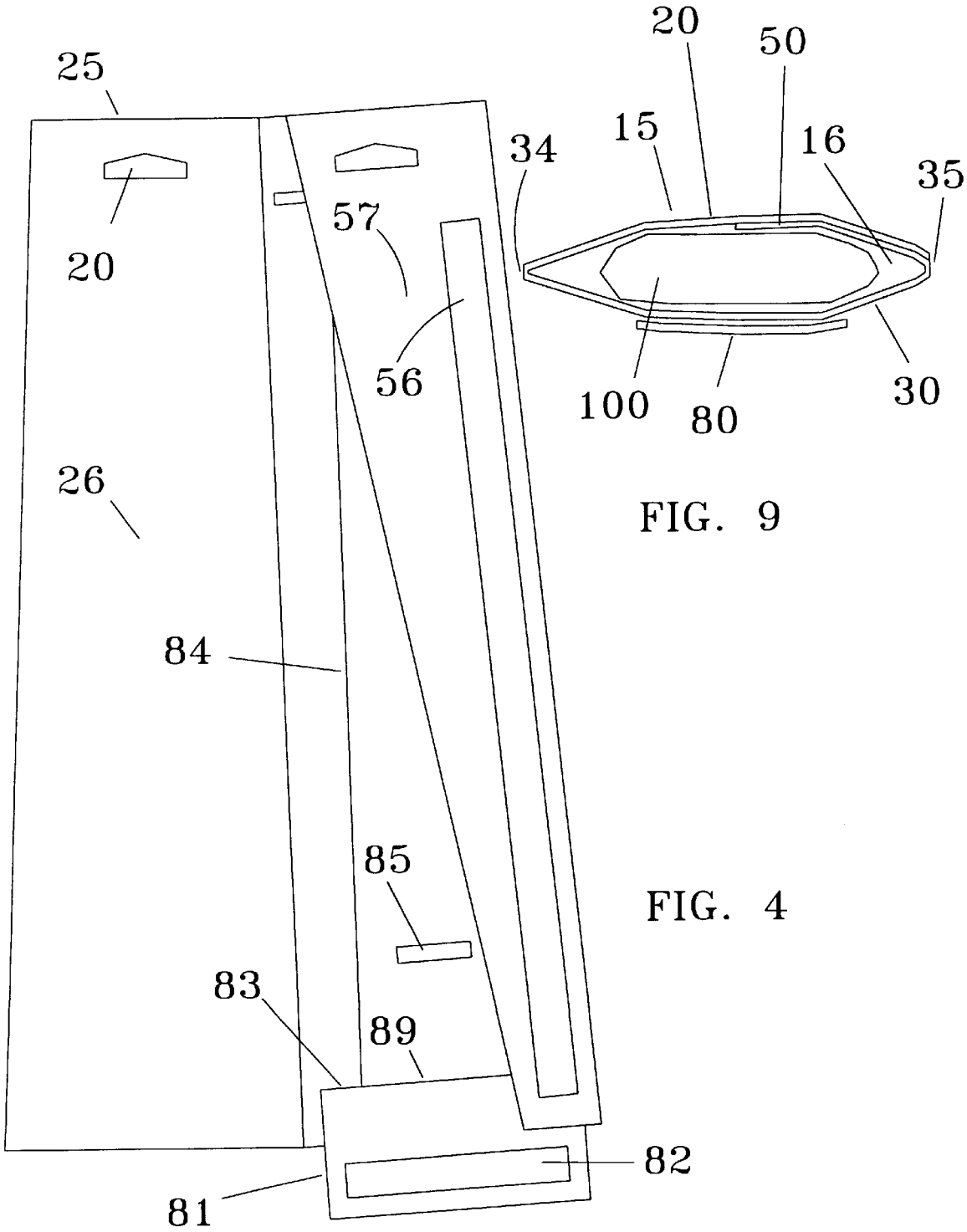
FIG. 4 is a view similar to that of FIG. 3, showing the right panel folded over a portion of the slide.
Figure 5:
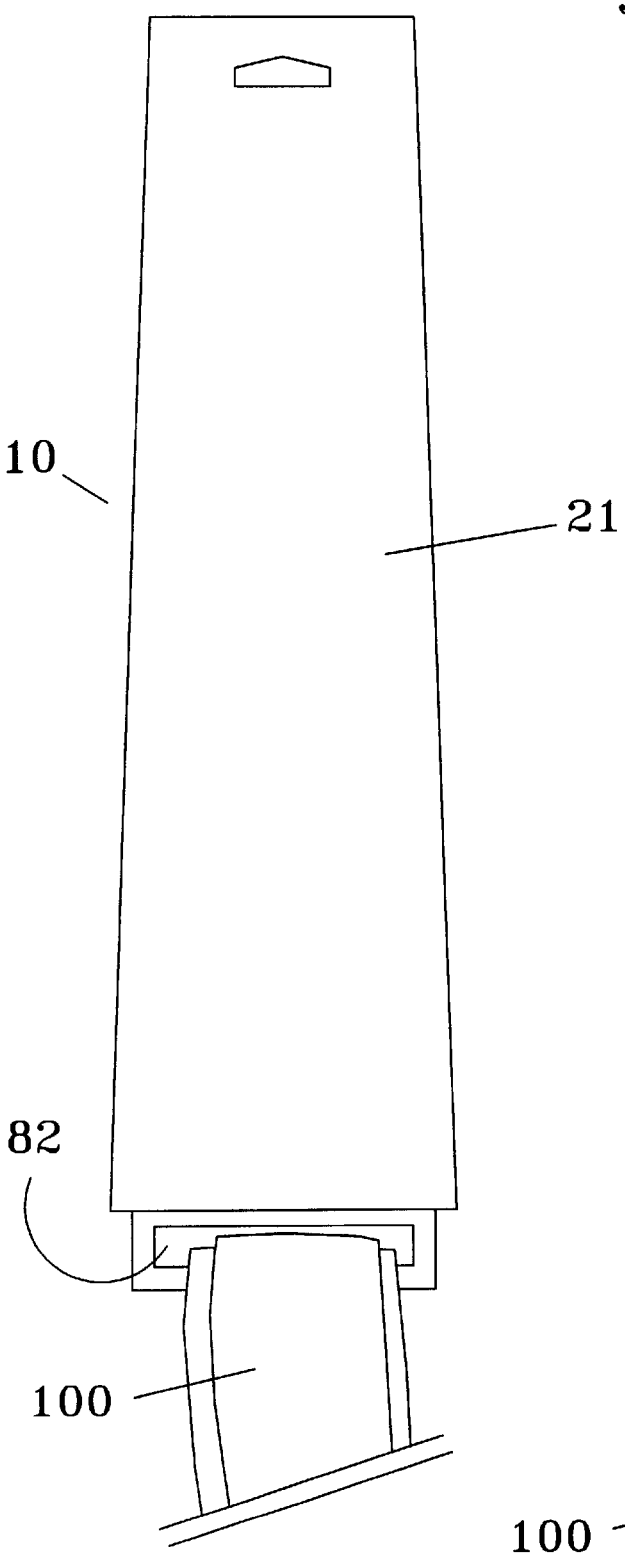

FIG. 5 is a view similar to that of FIG. 4, additionally having the left panel folded to a position adjacent and attached to the right panel, thereby showing the front portion of the assembled necktie storage case, with a necktie carried by the necktie slot defined in the necktie support panel of the slide, and the slide in the transfer position, wherein the necktie may be transferred to or from the necktie storage case.

Figure 6:
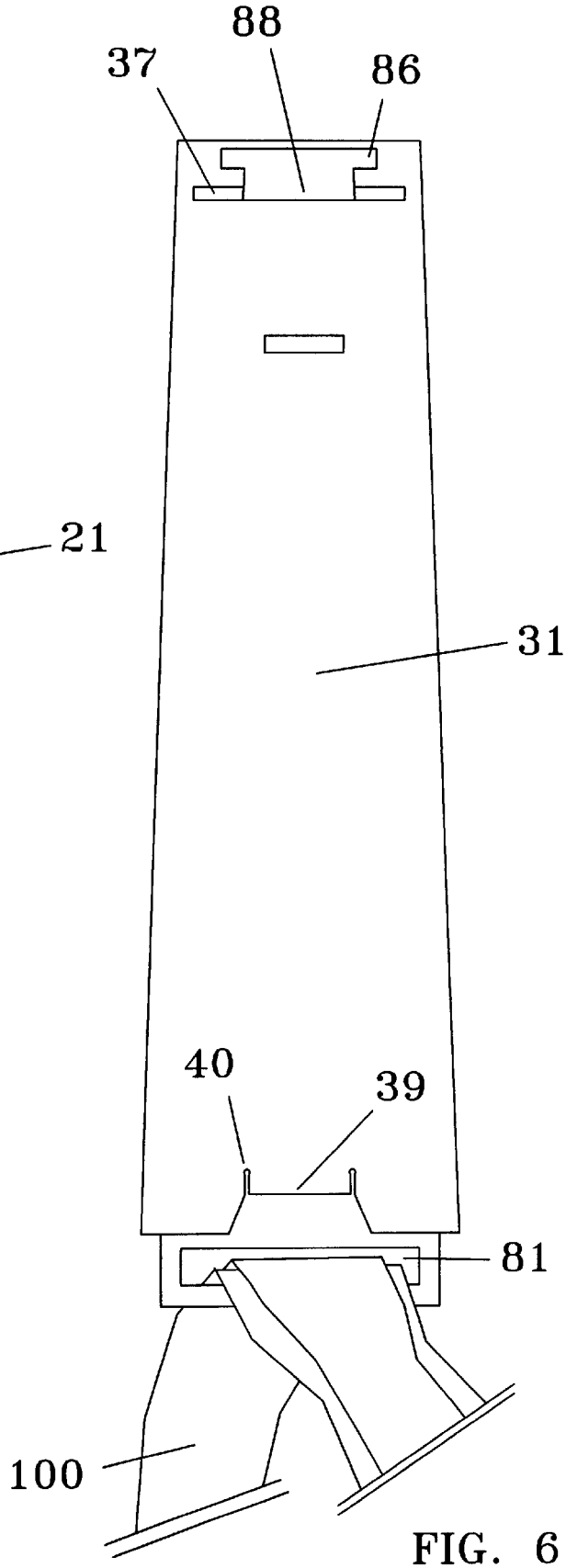

FIG. 6 is a view of the rear portion of the necktie storage case, in a view similar to that of FIG. 5.

Figure 7:
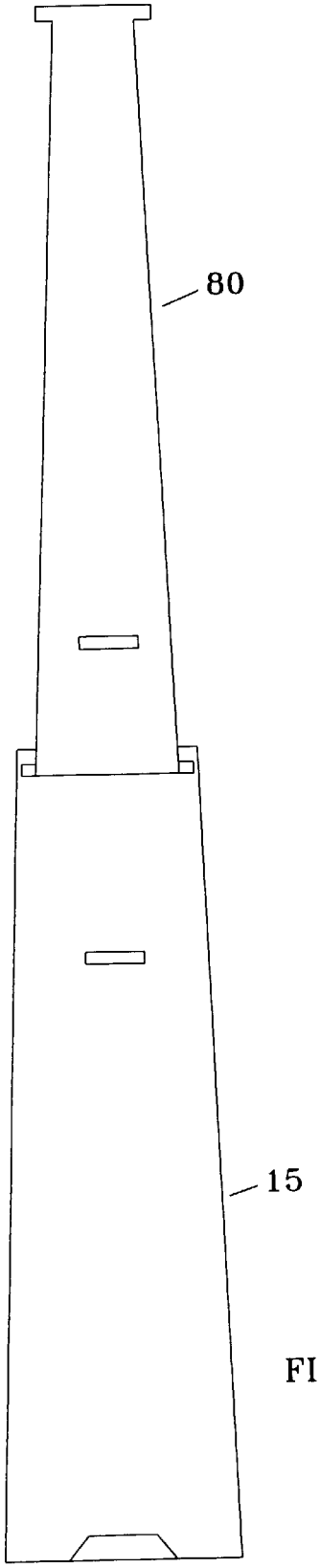

FIG. 7 is a view of the necktie storage case having the slide moved to the retracted position, wherein the necktie has been fully retracted into the channel of the envelope.

Figure 8:
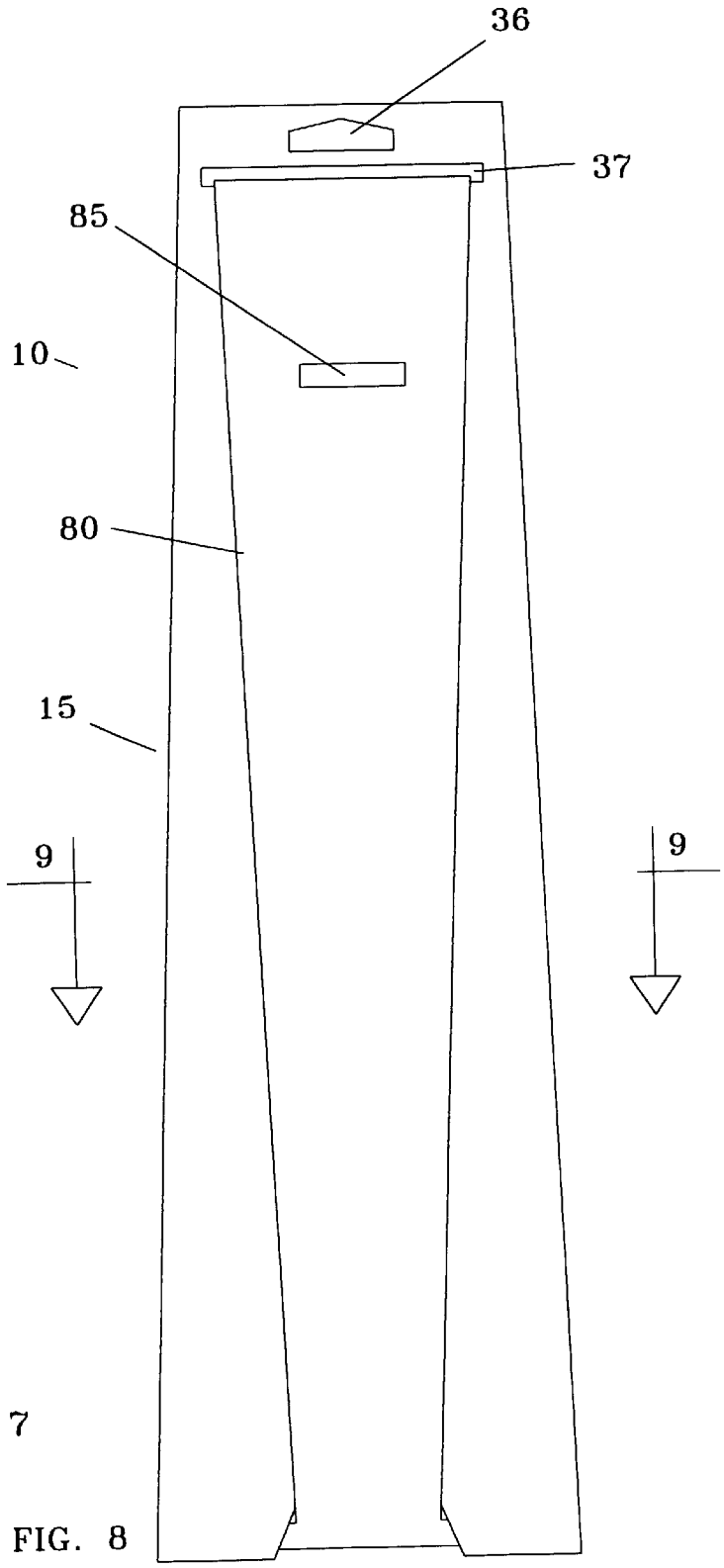

FIG. 8 is a view of the necktie storage case having the slide moved to the storage position, wherein the elongated body has been folded at 180 degrees with respect to the necktie support panel, and the fastening tabs are attached to the lower notch of the center panel.

FIG. 9 is a cross-sectional view taken along the 9—9 lines of FIG. 8.

DESCRIPTION

Referring in generally to FIGS. 1 through 9, a necktie storage case 10 constructed in accordance with the principles of the invention is seen. The necktie storage case 10 provides an envelope 15 defining a channel 16 sized to carry a folded necktie 100. A slide 80 allows convenient manual loading and unloading of a folded necktie into the interior channel of the envelope. The slide provides an elongated body sized for travel within the interior channel of the envelope and through a slide slot defined within the envelope. The elongated body of the slide carries a necktie support panel having a size which prevents passage through the slide slot. The slide is movable between three positions, a transfer position, wherein the necktie may be manually attached or removed from the slide; a retracted position, wherein the necktie is fully retracted within the interior channel of the envelope and the elongated body of the slide is withdrawn from the interior channel; and a storage position, wherein the elongated body of the slide is folded against and attached to an outside portion of the envelope.

Figure 1:
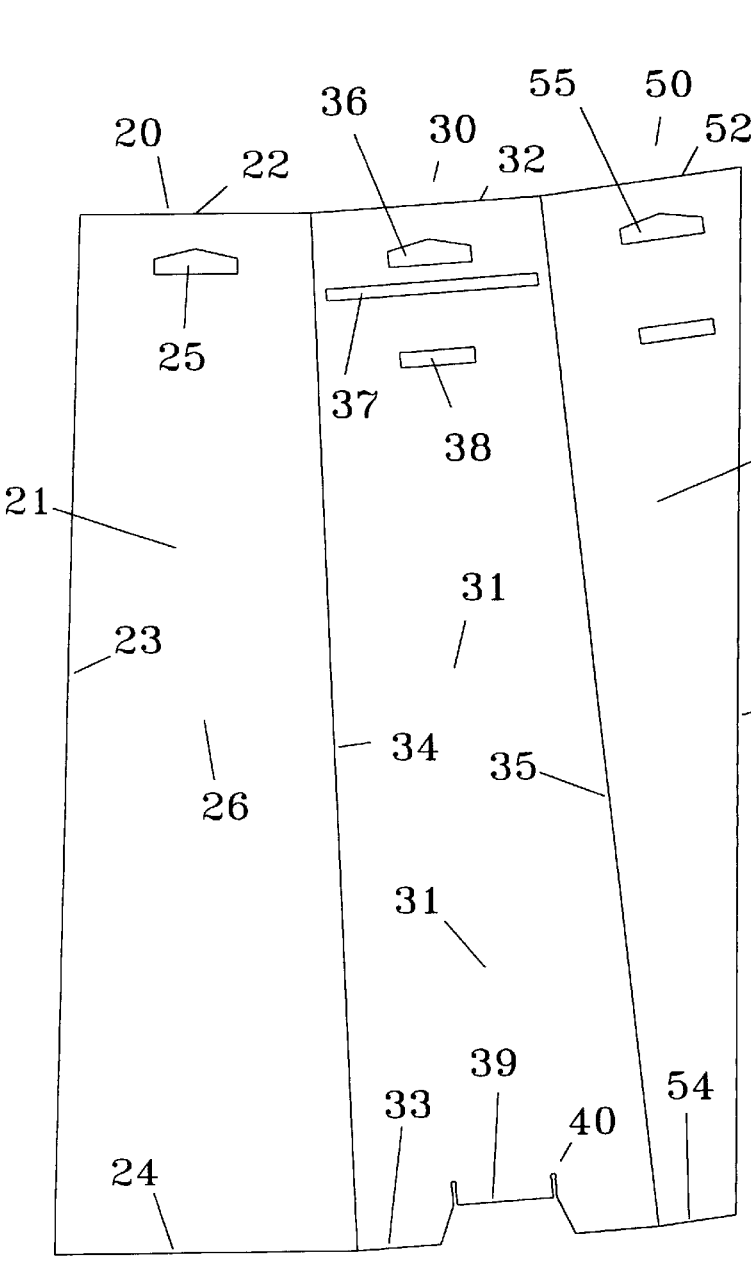
FIG. 1 is a top orthographic view of envelope portion of a version of the necktie storage case of the invention, in an unfolded state.

As seen particularly in FIG. 1, a preferred version of the envelope 15 includes a left panel 20, a center panel 30 and a right panel 50. The left and right panels are carried by the center panel by left and right folds 34, 35. As seen in FIG. 9, when the left and right panels are folded inwardly along folds 34, 35, they are fastened together by glue, adhesive or other fastening means to form a channel 16 within the envelope 15.

A preferred version of the envelope 15 is made of lightweight cardboard or paperboard, but may alternatively be made of other similar materials, as desired.

As seen in FIG. 1, the left panel 20 provides a generally planar body 21 having an upper edge 22, a left edge 23 and a lower edge 24. In a preferred version of the left panel, the upper edge is slightly shorter than the lower edge. A hanger opening 25 is defined in an upper portion of the planar body, and allows the passage of a J-hook or similar support when it is desired to hang the necktie storage case.

Continuing to refer to FIG. 1, the center panel 30 also provides a generally planar body 31, having an upper edge 32, a lower edge 33. In a preferred version, the size of the planar body 31 is substantially equal to the size of the planar body 21 of the left panel. As a result, when the left and center panels are folded together along the left fold 34 they overlap, as seen in FIGS. 5–8.

The center panel defines several holes, as seen in FIG. 1. A hanger opening 36 is the same size as the hanger opening 25 in the left panel, and is located to coincide with hanger opening 25 when the center and left panels are folded together about left fold 34.

A slid slot 37 is sized to allow passage of the elongated body 84 of the slide 80, but not to allow passage of the necktie support panel 81 of the slide. A window opening 38 allows a user to view a necktie carried within the channel 16, and to determine the identity of that necktie by its pattern and/or color.

A lower notch 39 having strain-relief notches 40 is defined in the lower edge 33 of the planar body 31. The lower notch is sized to allow attachment of the fastening tabs 86 carried by the elongated body 84 of the slide 80, as seen in FIG. 8. The strain-relief notches 40 tend to prevent tearing of center panel adjacent to the lower notch.

Continuing to refer to FIG. 1, the right panel 50 also provides a planar body 51 having an upper edge 52, right edge 53 and lower edge 54. In a preferred version of the right panel, the upper edge 52 is somewhat longer than the lower edge 54. This allows the combined envelope, including left, center and right panels to be cut more economically from a sheet of paperboard or other suitable material. By limiting the length of the lower edge 54, the size of the piece of paperboard required is also limited.

A hanger opening 55 is the same size as the hanger openings 25, 36 in the left and center panels, and is located to coincide with those openings when the left and right panels are both folded toward the center panel along the left and right folds 34, 35.

As seen in FIG. 4, an adhesive strip 56, or similar fastening means, is carried by an outside surface 57 of the right panel. During the assembly process, the adhesive strip is mated to the inside surface 26 of the left panel, thereby forming the envelope 15 and enclosing the channel 16.

Figure 2:
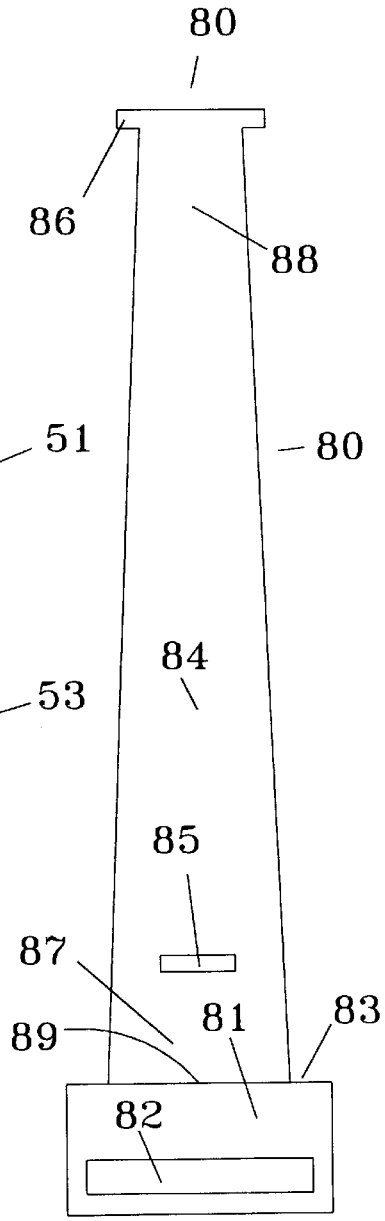
FIG. 2 is a top orthographic view of the slide portion of a version of the necktie storage case of the invention.

Referring to FIG. 2, the slide 80 is sized for travel within the interior channel 16 of the envelope 15, and allows for manual loading and unloading of a folded necktie into the interior channel 16 of the envelope 15. The slide provides an elongated body 84 and a necktie support panel 81, which are joined at fold 89.

The slide is movable between three positions. As seen in FIGS. 5 and 6, a transfer position allows a necktie to be manually transferred, i.e. attached or removed, to the necktie slot 82 defined in the necktie support panel of the slide. In the transfer position, the elongated body 84 is carried within the channel 16 of the envelope. Note that it is also possible to store the necktie case 10, carrying no necktie, in this position, if desired.

As seen in FIG. 7, in a retracted position the necktie is fully retracted within the interior channel 16 of the envelope and the elongated body of the slide is removed from the channel.

As seen in FIGS. 8 and 9, in a storage position a necktie is carried within the channel 16 for storage, and the elongated body of the slide is attached to the lower notch 39 of the center panel on an outside portion of the envelope 15. In this position, the elongated body 84 of the slide is outside the envelope, while the necktie support panel 81 is inside the channel 16.

The elongated body 84 is sized for passage through the slide slot 37 defined in the center panel. A preferred version of the elongated body is gradually tapers, from an upper portion 87 adjacent to the necktie support panel 81, to a lower portion 88 adjacent to the fastening tabs 36.

Opposed fastening tabs 86 allow the lower portion of the elongated body 84 to be secured to the lower notch 39 of the center panel, as seen in FIG. 8.

The elongated body defines a window opening 85 located to coincide with the window opening in the center panel when the slide is in a storage position, as seen in FIG. 8.

Figure 3:
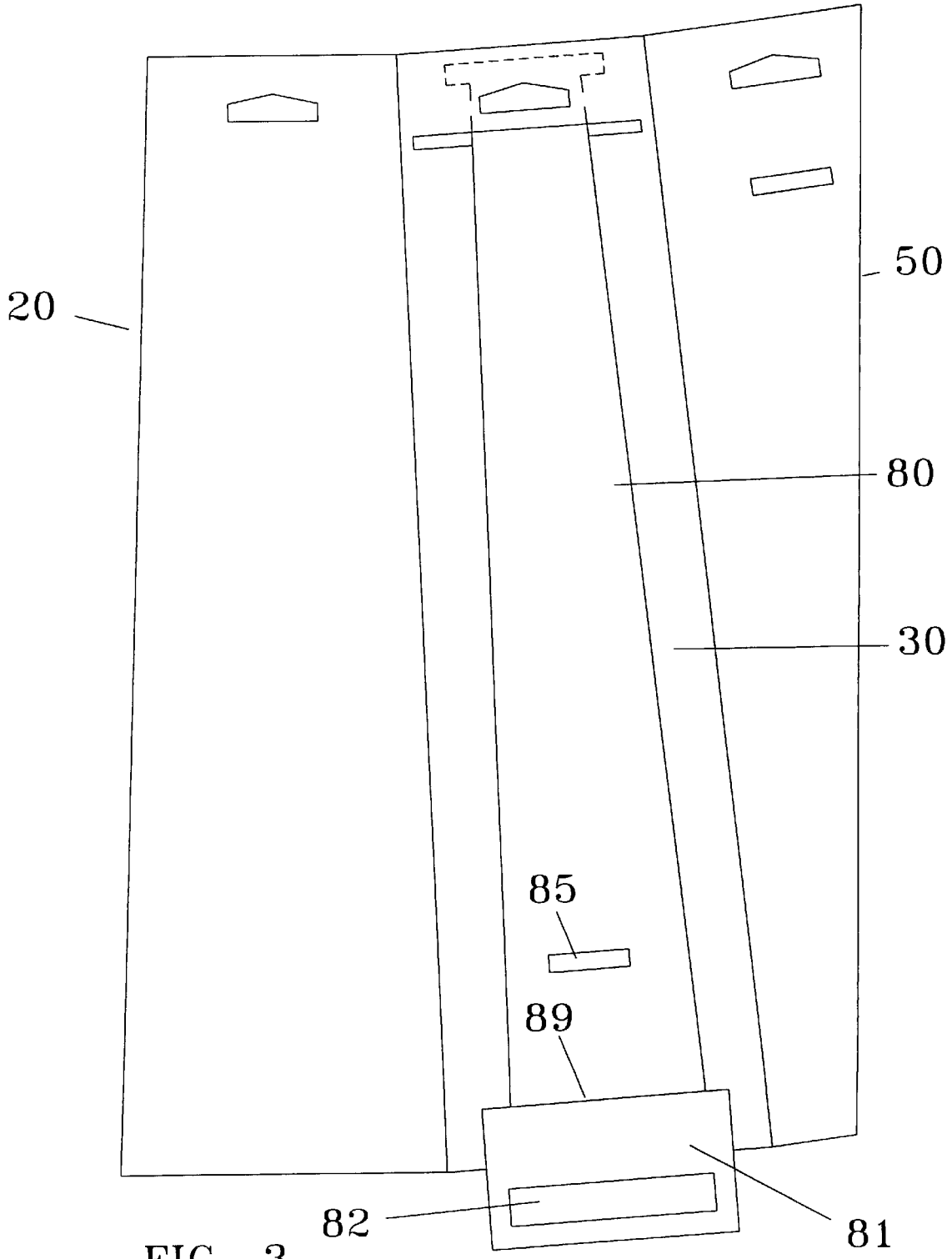
FIG. 3 is a top orthographic view of an end portion of the elongated body and opposed fastening tabs of the slide of FIG. 2, inserted through the slide slot defined in the center panel of the envelope portion of the necktie storage case.

As seen in FIGS. 2 and 3, the necktie support panel 81 is sized for passage within the channel 16, but provides shoulders 83 sized to prevent passage through the slide slot 37.

The necktie support panel provides a necktie slot 82, which is sized to allow passage of a necktie having been folded in half, and therefore having double-thickness, as seen in FIGS. 5 and 6.

To assemble the necktie storage case 10, the envelope 15 is typically oriented as seen in FIG. 3, with the lower portion 88 of the slide passing through the slide slot 37 in the center panel 30. The right panel 50 is then folded along the right fold 35, as seen in FIG. 4. The outside surface 57 of the right panel 50 is then fastened to the inside surface 26 of the left panel 20, by adhesive strip 56 or other fastening means.

The slide 80 may then be pulled upwardly, as seen in FIG. 7, and then bent at 180 degrees along fold 89. The fastening tabs 86 may then be installed in FIG. 8.

To use the necktie storage case 10, the user typically starts from the storage position seen in FIG. 8. The user first releases the fastening tabs 86 and folds the slide from the storage position seen in FIG. 8 to the retracted position seen in FIG. 7. The slide is then moved fully into the channel 16, until it is in the transfer position seen in FIGS. 5 and 6. A tie is then transferred onto the necktie slot 82 of the necktie support panel 81. The slide is then moved to the retracted position of FIG. 7, which causes the necktie to be fully pulled into the channel. The slide is then moved to the storage position seen in FIG. 8 and the tabs reattached.

The previously described versions of the present invention have many advantages, including a primary advantage of providing a novel necktie storage and travel case having a low manufacturing cost, allowing for enhanced sales and use in retail packaging.

Another advantage of the present invention is to provide a novel necktie storage and travel case that is simple and easy to use, thereby promoting widespread and frequent utilization.

A still further advantage of the present invention is to provide a novel necktie storage and travel case that is compact in use and which folds flat when not in use, and which is operational without bulky, elaborate and costly fasteners.

Although the present invention has been described in considerable detail and with reference to certain preferred versions, other versions are possible. For example, while a three-panel design for the envelope 15 is preferred, a two panel design could alternatively be substitutes. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A necktie storage case comprising:

(A) an envelope, sized for storage of a folded necktie within an interior channel; and (B) slide means, having an elongated body sized for travel within the interior channel of the envelope, for manual loading and unloading of a folded necktie into the interior channel of the envelope, comprising:

(a) a necktie support panel attached to the elongated body, wherein the elongated body is sized for passage through a slide slot defined in the center panel and wherein the necktie support panel is sized to prevent passage through the slide slot, the elongated body defining a window opening located to coincide with a window opening in the center panel when the slide is in a storage position.

2. A necktie storage case comprising:

(A) an envelope, sized for storage of a folded necktie within an interior channel, comprises:

(a) a left panel, having an elongated planar body with a lower edge of slightly greater length than an upper edge, the left panel defining a hanger opening in an upper portion of the elongated planar body;

(b) a center panel attached to the left panel along a left fold, having a similarly sized elongated body, having a hanger opening, a slide slot and a window opening defined on an upper portion of the elongated body, and having a lower notch defined along a lower edge of the elongated body; and (c) a right panel attached to the center panel along a right fold, having an elongated body, and having a hanger opening defined in an upper portion of the elongated body; and (B) a slide sized for travel within the interior channel of the envelope, for enabling manual loading and unloading of a folded necktie into the interior channel of the envelope, the slide having an elongated body and a necktie support panel, the elongated body sized for passage through the slide slot defined in the center panel and the necktie support panel sized to prevent passage through the slide slot, the elongated body defining a window opening located to coincide with the window opening in the center panel when the slide is in a storage position;

(C) wherein the slide is movable between a transfer position, wherein the necktie may be manually attached to, or removed from, the necktie support panel, and wherein the elongated body of the slide is carried within the channel, to a retracted position, wherein the necktie is fully retracted within the interior channel of the envelope and the elongated body of the slide is removed from the channel, to a storage position, wherein the elongated body of the slide is attached to an outside portion of the envelope.

* * * * *